United States Patent [19]

Kojima

[11] Patent Number: 4,844,421

[45] Date of Patent: Jul. 4, 1989

[54] OPERATING DEVICE FOR ELECTRIC HOIST

[75] Inventor: Yasuhiro Kojima, Kawasaki, Japan

[73] Assignee: Kabushiki Kaisha Kito, Japan

[21] Appl. No.: 154,169

[22] Filed: Feb. 9, 1988

[30] Foreign Application Priority Data

Feb. 18, 1987 [JP] Japan ..... 62-33515
Sep. 8, 1987 [JP] Japan ..... 62-225948

[51] Int. Cl.[4] ..... B66D 1/46; H01H 9/06

[52] U.S. Cl. ..... 254/270; 200/298; 254/362

[58] Field of Search ..... 254/270, 358, 362, 361, 254/372, 380, 360; 200/298, 314, 315, 357, 353 T

[56] References Cited

U.S. PATENT DOCUMENTS

| | | | |
|---|---|---|---|
| 2,878,346 | 3/1959 | Andrews et al. | 200/315 |
| 2,939,680 | 6/1960 | Powell | 254/361 X |
| 3,093,718 | 6/1963 | Blomquist et al. | 200/314 |
| 3,493,832 | 2/1970 | Kay | 318/305 X |
| 3,639,745 | 2/1972 | Shiki | 200/314 X |
| 3,681,552 | 8/1972 | Bailey | 200/314 X |
| 3,755,725 | 8/1973 | Cordes | 200/157 X |
| 3,784,165 | 1/1974 | Pruitt | 254/380 X |
| 3,921,959 | 11/1975 | Ulbing | 254/270 |
| 3,948,487 | 4/1976 | Motoda | 254/362 |
| 4,758,724 | 7/1988 | Osika | 200/315 |

FOREIGN PATENT DOCUMENTS

| | | | |
|---|---|---|---|
| 7042 | 12/1986 | World Int. Prop. O. | 254/360 |

*Primary Examiner*—Joseph J. Hail, III
*Attorney, Agent, or Firm*—Sughrue, Mion, Zinn, Macpeak & Seas

[57] ABSTRACT

An operating device for an electric hoist, comprises a switch box and a cylindrical body connected to a lower end of a chain depending from a main body of the electric hoist for lifting a load. To a lower end of the cylindrical body is connected a lower hook hanging the load to be lifted. The operating device further comprises a grip vertically slidably fitted on the cylindrical body and kept at a substantially mid position of a slidable distance of the grip relative to the cylindrical body, raising and lowering switches for raising and lowering the load provided in the cylindrical body to be actuated by a striker fixed to the grip, high and low speed alteration switch provided in the switch box for changing high and low operating speeds of the electric hoist, and a stepless speed adjusting device for adjusting the high and low operating speeds of the electric hoist in a stepless manner.

6 Claims, 5 Drawing Sheets

OPERATING DEVICE FOR ELECTRIC HOIST

BACKGROUND OF THE INVENTION

This invention relates to an operating device for an electric hoist for changing high and low speeds for raising and lowering a load by an electric hoist and more particularly controlling the speeds in a stepless manner within the high and low speed ranges.

The term "hoist" as used herein is intended to designate means inclusive a chain block having a DC motor for lifting a load.

Operating devices for electric hoists have been known disclosed such as Japanese Patent Application Laid-open No. 51-132,569. An operating device disclosed in the laid-open application comprises a switch box provided between a hook for hanging a load and a lower end of a chain depending from a main body of the hoist and push buttons for raising and lowering switches provided on a grip laterally extending from the switch box.

With such an operating device, as the push buttons are provided on the grip laterally extending from the switch box, the grip will be subjected to vertical forces when the push buttons are operated while the grip is held. Therefore, the switch box and the hook for hanging the load are often tilted so that engaging operation of the hook with the load may become difficult. In the operating device of the Laid-open application, moreover, the raising or lowering speed could not be changed. It is therefore impossible to decrease the raising or lowering speed when starting or stopping the operation in order to prevent any shock acting upon a load. It is also impossible to increase the raising or lowering speed when the load is being lifted in order to improve lifting efficiency.

An electric chain block capable of changing raising or lowering operating speed in a stepless manner has been disclosed in Japanese Utility Model Application Laid-open No. 62-189,389 filed by the applicant. With the electric chain block of the Utility Model, when changing the operating speed from high to low or low to high speed, it takes much time to arrive at low or high speed in the stepless speed control. In other words, the known chain block is inferior in responsibility in the change in speed.

The applicant has proposed a further electric chain block whose operating speed is able to be switched over stepwise from high to low or low to high speed by an alteration switch or the like and to be adjustable in a stepless manner in a high or low speed range (Japanese Utility Model Application No. 132,605/86). With this chain block, however, the change of the raising and lowering operations is carried out at an operating device provided at a location remote from a chain and a hook of the chain block. Therefore, an operator operates the electric chain block in a sense quite different from that when he is lifting a heavy object by himself. Therefore, the hitherto used electric chain blocks or hoists are lacking in simplicity in operation.

SUMMARY OF THE INVENTION

It is a primary object of the invention to provide an operating device for an electric hoist which eliminates all the disadvantages of the prior art and which enables the electric hoist to change operating speeds stepwise.

It is another object of the invention to provide an operating device for an electric hoist, which enables an operator to raise and lower a load in the same sense as an operator raises and lowers the load by himself and which is easy in operation and high responsive to speed changes and is able to change high and low speeds stepwise and to adjust speeds within high and low speed ranges in a stepless manner.

In order to achieve these objects, the operating device for an electric hoist according to the invention comprises a switch box and a cylindrical body connected to a lower end of an elongated member depending from a main body of said electric hoist for lifting a load, to a lower end of said cylindrical body being connected means for hanging the load to be lifted, a grip vertically slidably fitted on said cylindrical body and kept at a substantially mid position of a slidable distance of the grip relative to said cylindrical body, raising and lowering switch means for raising and lowering the load, said raising and lowering switch means being provided in said cylindrical body to be actuated by a switch abutting member fixed to said grip, and high and low speed alteration switch means provided in said switch box for changing high and low operating speeds of said electric hoist.

The device further comprises stepless speed adjusting means for adjusting at least one of the high and low operating speeds of the electric hoist in a stepless manner. The stepless speed adjusting means comprises a speed adjusting knob provided in the proximity of the switch box and a variable resistor whose resistance value is changed by rotation of the knob.

With the operating device for an electric hoist constructed as above described, the switching over of raising and lowering operations is effected by raising and lowering the grip and the switching over of high and low speeds is effected by operation of the high and low speed alteration switch arranged in the switch box provided at the end of the cylindrical body. Moreover, the speed adjustment in the high and/or low speed range is carried out by operation of the high and/or low speed adjusting knob arranged on the switch box. An operator can therefore operate the electric hoist at any desired speed and stands immediately above a load to be lifted so as to operate the hoist according to movements of the load. Therefore, the raising and lowering operations are effected by the operator in the same sense as the operator raises and lowers the load by himself.

In order that the invention may be more clearly understood, preferred embodiments will be described, by way of example, with reference to the accompanying drawings.

DESCRIPTION OF THE PREFERRED EMBODIMENTS

Figure 1A:
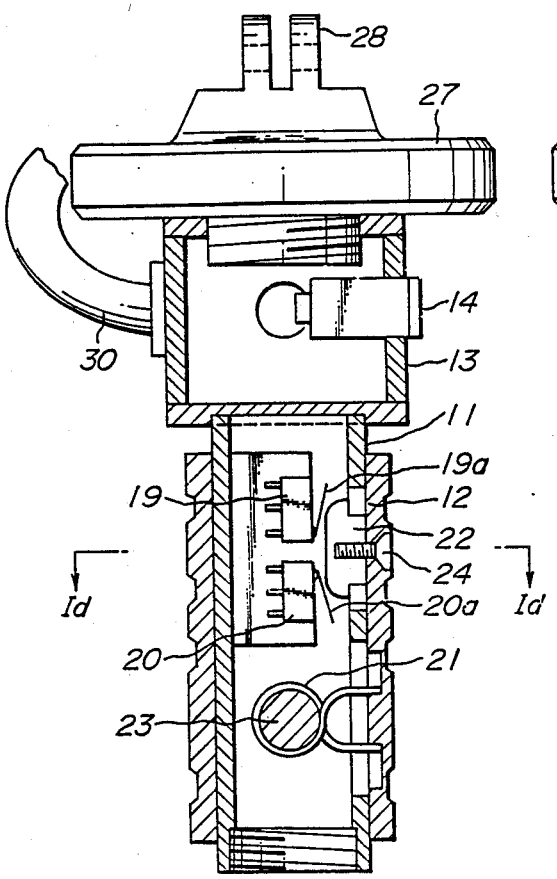
FIG. 1*a* is a partial sectional view of one embodiment of the operating device according to the invention.
Figure 1B:
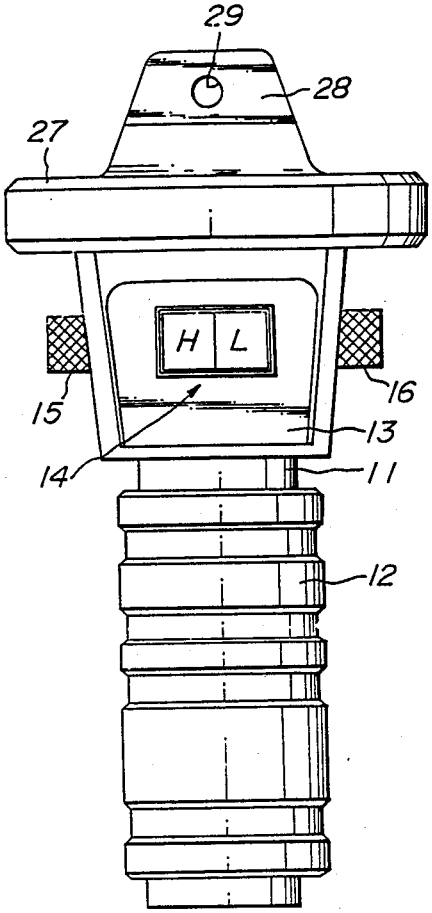
FIG. 1*b* is a front view of the operating device shown in FIG. 1*a;*
Figure 1C:
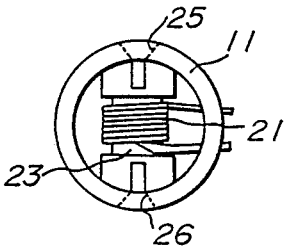
FIG. 1*c* is a bottom plan view of a cylindrical body and a spring used in the operating device shown in FIG. 1*a;*
Figure 1D:
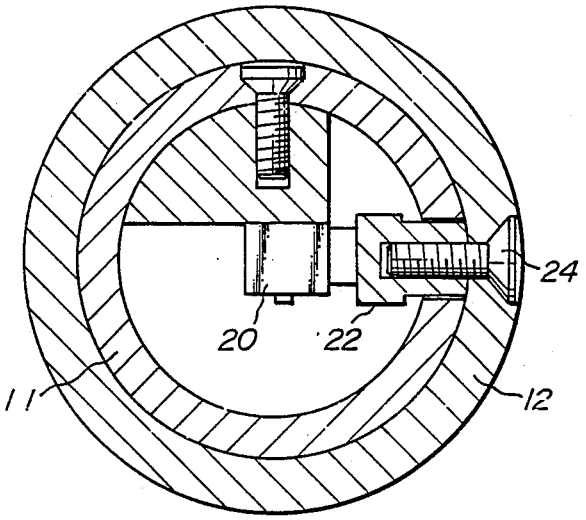
FIG. 1*d* is a sectional view of the operating device taken along a line I*d*—I*d* in FIG. 1*a;*

FIGS. 1*a*–1*d* illustrate a first embodiment of the operating device according to the invention. The device comprises a cylindrical body 11 and a cylindrical grip 12 vertically slidable a predetermined distance on the cylindrical body 11. The grip 12 is made of rubber having on its outer surface a number of annular protrusions spaced in its axial direction for preventing slippage of a hand of an operator on the grip. The cylindrical body 11 is provided therein limit switches 19 and 20 adapted to be actuated by a switch abutting member or striker 22 fixed to an inner surface of the grip 12 by means of a set screw 24. In more detail, when the grip 12 is slidably moved upwardly, the switch abutting member or striker 22 pushes a lever 19*a* of the limit switch 19 to turn it on. On the other hand, when the grip 12 is moved downwardly, the abutting member or striker 22 pushes a lever 20*a* of the limit switch 20 to turn it on. A torsion spring 21 is coiled about a shaft 23 and thereby fixed to the cylindrical body 11 and has ends engaging grooves of the grip 12 to hold the grip 12 in its neutral position, keeping the limit switches 19 and 20 off. The shaft 23 is fixed to the cylindrical body 11 by set screws 25 and 26.

On an upper portion of the cylindrical body 11, there is provided a box-like bracket or switch box 13 having at a front surface a high and low speed alteration switch 14 for switching over high and low speeds and speed adjusting knobs 15 and 16 on both sides for adjusting speeds in high and low speed ranges in stepless manner, respectively. Onto an upper portion of the bracket or switch box 13 is fixed a flange 27 which is provided thereon with a pair of protrusions 28 spaced a predetermined distance to form a clearance therebetween. A lower end of a chain later described for raising and lowering a load is inserted into the clearance and fixed thereat by a pin inserted in apertures 29 formed in the protrusions 28, thereby fixing main components of the operating device to the chain.

The high and low speed alteration switch 14 comprises one push button having a surface divided two halves respectively indicating high and low speeds by letters "H" and "L". Light sources such as lamps or light emission diodes are built in the push button. When the push button is pressed, it is illuminated from an inside on the side of "H". Upon pushing the button again, the illumination on the side of "H" is turned off and the push button is illuminated from an inside on the side of "L". The speed adjusting knobs 15 and 16 are geared with variable resistors, respectively, for adjusting the speeds in stepless manner within high and low speed ranges.

Figure 2:
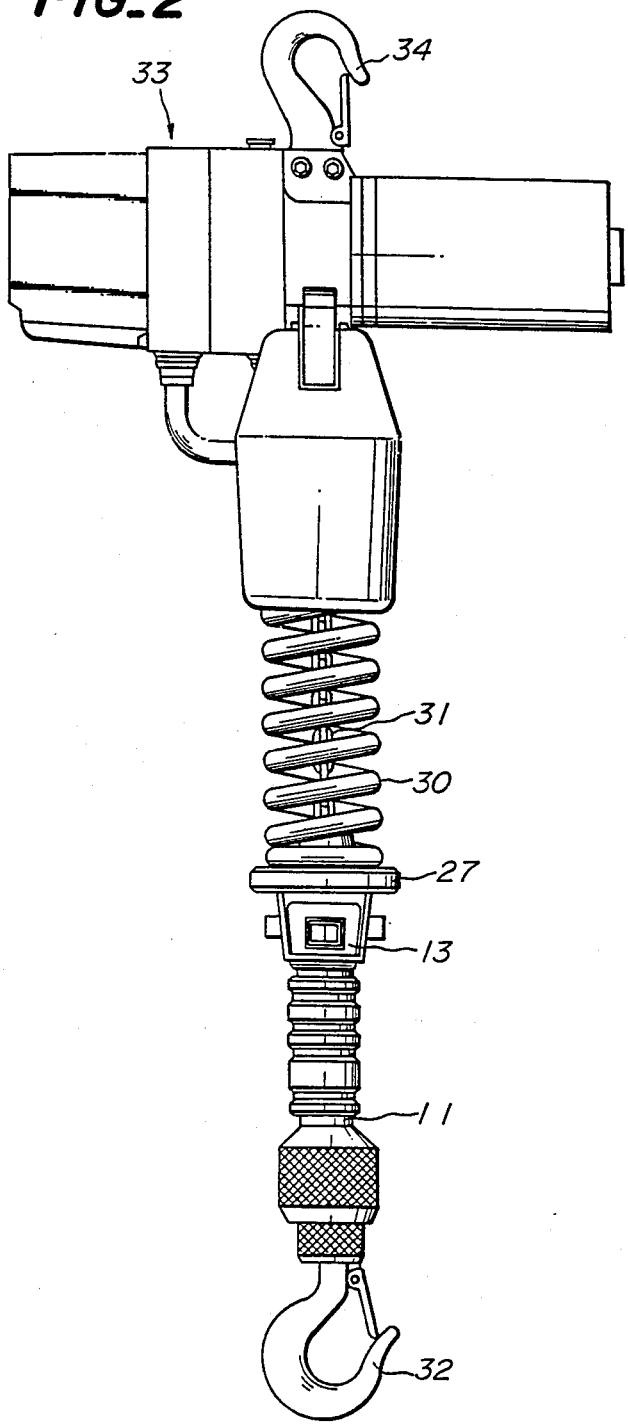
FIG. 2 is a view illustrating a chain block equipped with the operating device according to the invention.

FIG. 2 illustrates an electric chain block in its entirety equipped with the operating device above described according to the invention. As shown in the drawing, a hook 32 for lifting load is connected to the lower end of the cylindrical body 11. The lower end of the chain 31 for raising and lowering the load is fixed to the protrusions 28 of the flange 27 as above described. As shown in FIG. 2, the chain block includes a driving portion 33 having therein a DC motor and a hook 34 for hanging the chain block.

The switches 14, 19 and 20 are connected to a power source control portion for the electric chain block through a spiral cable 30 which is extensible and contractible.

Figure 3:
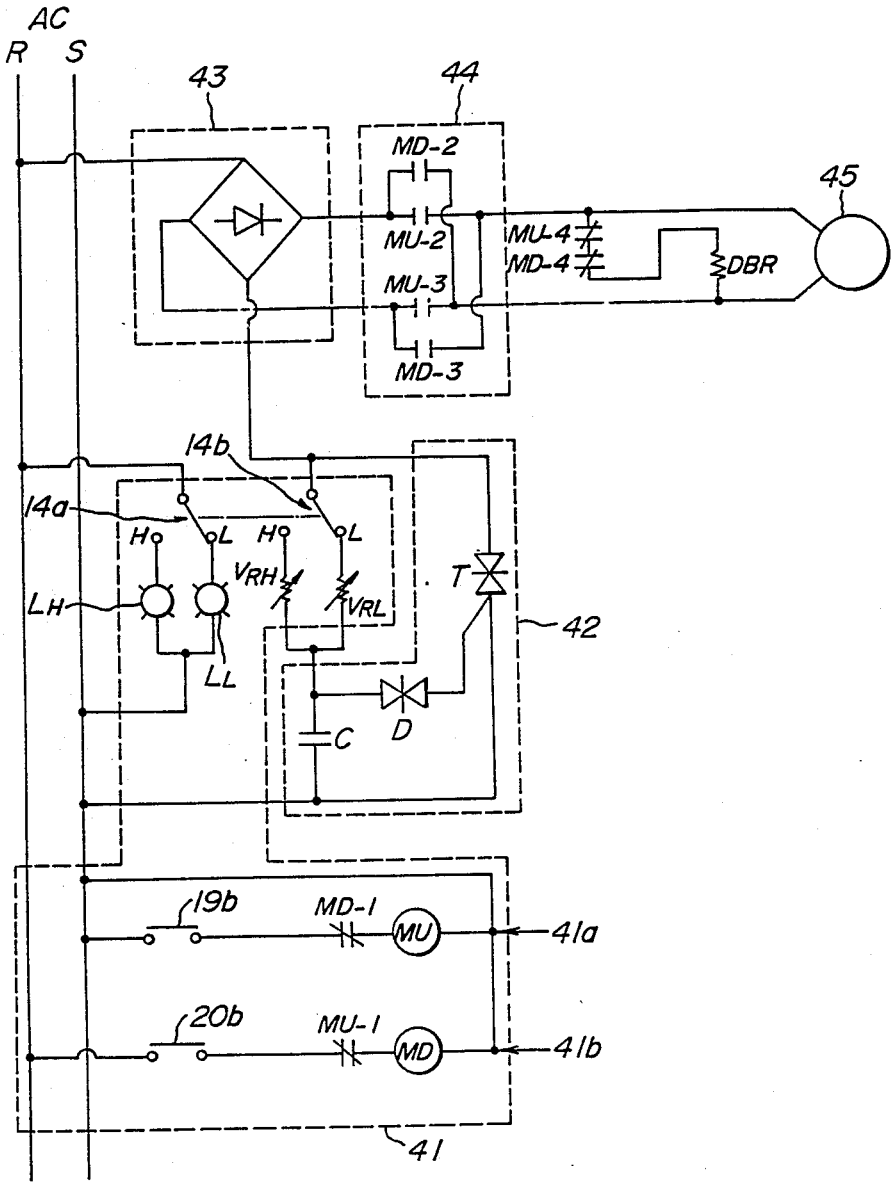
FIG. 3 is a control circuit for the operating device according to the invention.

FIG. 3 illustrates a control circuit for use in the operating device for the chain block according to the invention, which comprises an operating circuit 41, a phase control circuit 42, a full-wave rectifying circuit 43, a normal and reverse rotating circuit 44, a dynamic brake DBR and a DC motor 45.

The operating circuit 41 consists of a windingup or load raising circuit 41*a*, a winding-off or load lowering circuit 41*b*, contact pairs 14*a* and 14*b* of a high and low speed alteration switch 14, a high speed lamp $L_H$, a low speed lamp $L_L$, a high speed variable resistor $V_{RH}$, and a low speed variable resistor $V_{RL}$.

The load raising circuit 41*a* is a series circuit of a contact pair 19*b* of the limit switch 19 for detecting the winding-up or raising operation, a normally closed contact pair MD-1 of a relay for the winding-off operation, and a relay MU for the winding-up or raising operation. The load lowering circuit 41*b* is a series circuit of a contact pair 20*b* of the limit switch 20 for detecting the winding-off or lowering operation, a normally closed contact pair MU-1 of a relay for the winding-up or raising operation, and a relay MD for the winding-off or lowering operation.

The variable resistors $V_{RH}$ and $V_{RL}$ for high and low speeds are connected in parallel and are switched over by a contact pair 14*b* of the high and low speed alteration switch 14. The high speed variable resistor $V_{RH}$ serves to control the speed within the high speed range in a stepless manner. Resistance values Of the variable resistor $V_{RH}$ are varied by rotation of the speed adjusting knob 15. The low speed variable resistor $V_{RL}$ whose resistance values are varied by rotation of the speed adjusting knob 16 serves to control the speed within the low speed range in a stepless manner.

The high and low speed lamps $L_H$ and $L_L$ are connected in parallel and are switched over by the contact pair 14*a* of the high and low speed alteration switch 14.

The phase control circuit 42 comprises a capacitor C, a two-way trigger diode SBS (trigger element D such as silicon bilateral switch or the like) and a triode AC switch T.

The normal and reverse rotating circuit 44 comprises normally opened contact pairs MU-2 and MU-3 of the relay MU for the winding-up or raising operation, and normally opened contact pairs MD-2 and MD-3 of the relay MD for the winding-off or lowering operation. To a dynamic brake resistor DBR are connected in series a normally closed contact pair MU-4 of the relay MU for the winding-up or raising operation and a normally closed contact pair MD-4 of the relay MD for the winding-off or lowering operation.

With the control circuit constructed as above described, when the push button of the high and low speed alteration switch 14 is pressed at the high or low speed side "H" or "L", the contact pairs 14*a* and 14*b* are closed on the high or low speed side to put the high or low speed lamp $L_H$ or $L_L$ off and to connect the high or low speed variable resistor $V_{RH}$ or $V_{RL}$.

Under this condition, when the grip 12 is moved upward, the contact pair 19*b* of the limit switch 19 is closed to cause current to flow from an alternating current power source AC to the relay MU for the windingup or raising operation to actuate the relay MU so that the normally opened contact pairs MU-2 and MU-3 of the relay MU are closed and the normally closed contact pairs MU-1 and MU-4 are opened. As a result, the alternating current from the power source AC is phase-controlled in the phase control circuit 43 and full-wave rectified in the full-wave rectifying circuit 43. The rectified current is then supplied into the DC motor 45 so as to energize it in a normal rotating direction. The power to be supplied to the DC motor is controlled to adjust its rotating speed by resistance values of the high or low speed variable resistor $V_{RH}$ or $V_{RL}$ according to whether the high and low speed alteration switch 14 is on the high or low speed side.

If alternating twin motors having different rotating speeds is used instead of the DC motor, the high and low speed motors may be switched over by operation of the switch 14.

In the above embodiment, there are provided the two speed adjusting knobs 15 and 16 which adjust resistance values of the high and low speed variable resistors $V_{RH}$ and $V_{RL}$ to adjust the raising and lowering speeds within the high and low speed ranges in the stepless manner. However, it is of course that either one of the high and low speed ranges may be limited to constant, and the other speed range may be adjustable. Although the stepless adjustment of the speeds has been explained in the above embodiment, they may of course be finely adjusted in a plurality of steps.

Moreover, the bracket or switch box 13 is provided at the upper end of the cylindrical body 11 in the above embodiment. However, the bracket 13 may be provided at the lower end of the cylindrical body 11 so long as the bracket 13 is fixed to one end of the cylindrical body 11 directly or indirectly.

The operating device according to the invention may be constructed so as to carry out the speed control in the following manner different from those above described. In changing the speeds for raising or lowering operation, when the grip 12 is raised or lowered to actuate the limit switch 19 or 20 by the switch abutting member or striker 22, the raising or lowering operation is effected at a low speed. Moreover, when the switch 14 is pressed while the raising or lowering operation is effected at a low speed, the low speed is changed to a high speed, and upon releasing the switch 14, the high speed is changed to the low speed.

With the electric hoist equipped with the operating device according to the invention, the high speed may be used for raising or lowering an empty box or the hook 32 without any load or on the way of raising or lowering a load. The low speed may be used at the start or end of raising a load or when a load is being seated. Moreover, when a hanged load to be lowered onto a predetermined position is not located directly above the predetermined position, the grip 8 is laterally pushed to move the load hanged by the hook connected to the lower end of the cylindrical body 11 to a position immediately above the predetermined position and the load is lowered at the low speed, thereby easily lowering the load at the predetermined position with ease.

Figure 4:
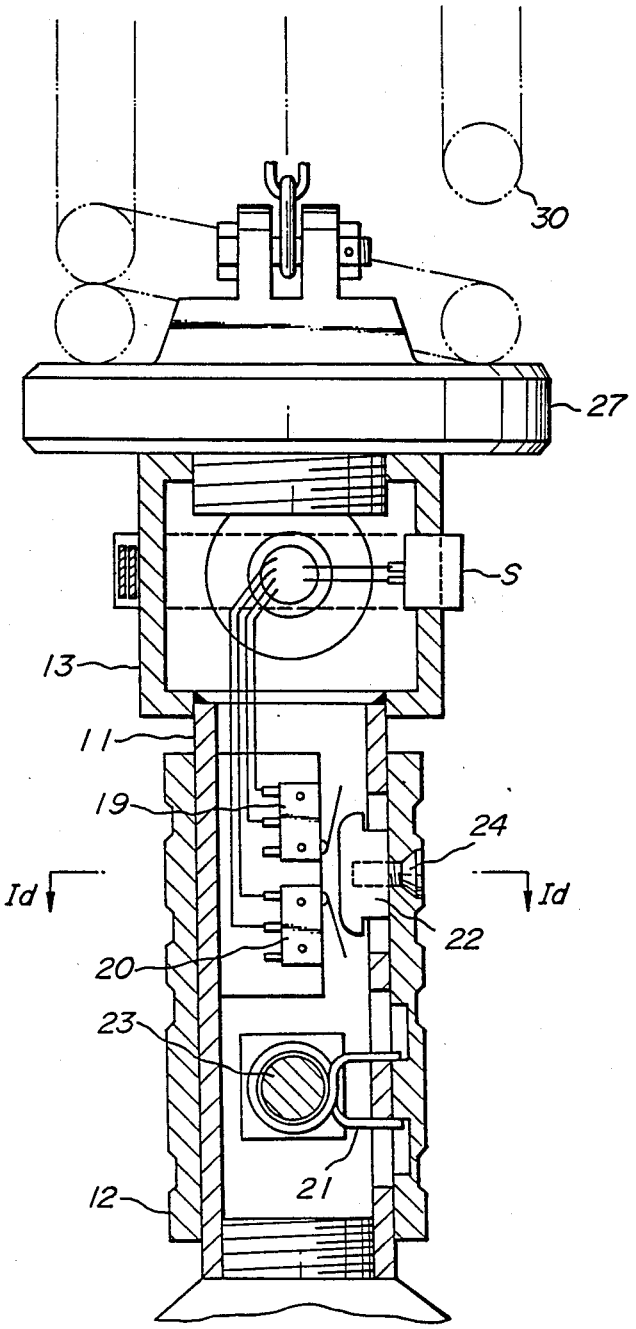
FIG. 4 is a partial sectional view of another embodiment of the operating device according to the invention.

FIG. 4 illustrates another embodiment of the operating device according to the invention. A high and low speed alteration switch S in the form of a tape or cord switch is used, which surrounds a switch box or bracket 13 and is fixed thereto by an adhesive. The switch S may be actuated from any directions around the grip 12.

In carrying out the invention, any hanging metal member may be used instead of the hook 32. Moreover, the upper end of the electric hoist may be connected to a lower portion of a frame of a trolley having driving means whose wheels are arranged on flanges of traveling rails arranged at a ceiling of a building. A snap switch may be used as the high and low speed alteration switch S instead of a push-button switch.

With the operating device according to the invention, when the grip 12 is raised from its neutral position by one hand of an operator gripping the grip 12, the switch abutting member 22 provided on the grip 12 actuates the switch 19 to start the raising operation. On the other hand, when the grip 12 is lowered from its neutral position by the hand, the switch abutting member 22 actuates the switch 20 to start the lowering operation. As a result, by a simple operation of raising or lowering the grip 12, the raising or lowering operation is effected with ease. moreover, even when any load is not hanged by the hook 32, the raising or lowering operation is effected without tilting the hook 32. By operating the switch 14 or S, the raising or lowering speed is changed from a high speed to a low speed or vice versa. Therefore, it is possible to change the high speed to the low speed to reduce a shock at the start or end of raising a load, and it is possible to change the low speed to the high speed on the way of raising or lowering the load to improve the lifting efficiency.

With the operating device as constructed as above described according to the invention, the switching over of raising and lowering operations is effected by raising and lowering the grip, and the switching over of high and low speeds is effected by operation of the high and low speed alteration switch arranged in the switch box provided at the end of the cylindrical body. Moreover, the speed adjustment in the high and/or low speed range is carried out by operation of the high and/or low speed adjusting knob arranged on the switch box. Therefore, an operator can operate the electric hoist at any desired speeds and stands immediately above a load to be lifted so as to operate the hoist according to movements of the load. Accordingly, the electric hoist according to the invention has a superior advantage in that the raising and lowering operations are effected by the operator in the same sense as the operator raises and lowers the load by himself.

It is further understood by those skilled in the art that the foregoing description is that of preferred embodiments of the disclosed device and that various changes and modifications may be made in the invention without departing from the spirit and scope thereof.

What is claimed is:

1. An operating device for an electric hoist, comprising a switch box and a cylindrical body connected to a lower end of an elongated member depending from a main body of said electric hoist for lifting a load, a lower end of said cylindrical body being connected to means for hanging the load to be lifted, a grip vertically slidably fitted on said cylindrical body and kept at a substantially mid position of a slidable distance of the grip relative to said cylindrical body, raising and lowering switch means for raising and lowering the load, said raising and lowering switch means being provided in said cylindrical body to be actuated by a switch abutting member fixed to said grip, and high and low speed alteration switch means provided in said switch box for changing high and low operating speeds of said electric hoist and wherein said grip is kept at the mid position by means of a torsion spring coiled about a shaft fixed to said cylindrical body and having ends engaging grooves formed in said grip.

2. An operating device as set forth in claim 1, wherein said high and low speed alteration switch means comprises one push button for switching over the high and low operating speeds and having therein light sources for indicating the high and low operating speeds.

3. An operating device as set forth in claim 1, wherein said high and low speed alteration switch means is a cord switch surrounding an outer circumference of said switch box and fixed thereto.

4. An operating device as set forth in claim 1, wherein said device further comprises stepless speed adjusting means for adjusting at least one of said high and low operating speeds of said electric hoist in a stepless manner.

5. An operating device as set forth in claim 4, wherein said stepless speed adjusting means comprises a speed adjusting knob provided in the proximity of said switch box and a variable resistor whose resistance value is changed by rotation of said knob.

6. An operating device for an electric hoist, comprising a switch box and a cylindrical body connected to a lower end of an elongated member depending from a main body of said electric hoist for lifting a load, a lower end of said cylindrical body being connected to means for hanging the load to be lifted, a grip vertically slidably fitted on said cylindrical body and kept at a substantially mid position of a slidable distance of the grip relative to said cylindrical body, raising and lowering switch means for raising and lowering the load, said raising and lowering switch means being provided in said cylindrical body to be actuated by a switch abutting member fixed to said grip, and high and low speed alteration switch means provided in said switch box for changing high and low operating speeds of said electric hoist, wherein said device further comprises stepless speed adjusting means for adjusting at least one of said high and low operating speeds of said electric hoist in a stepless manner and wherein said stepless speed adjusting means comprises two speed adjusting knobs provided in the proximity of said switch box, and two variable resistors whose resistance values are changed by rotation of said knobs, respectively, for adjusting said high and low operating speeds.

* * * * *